United States Patent [19]

Graf et al.

[11] Patent Number: 4,728,008

[45] Date of Patent: Mar. 1, 1988

[54] DISPENSER FOR FLOWABLE MEDIA

[75] Inventors: Lothar Graf, Worblingen; Karl-Heinz Fuchs, Radolfzell, both of Fed. Rep. of Germany

[73] Assignee: Ing. Erich Pfeiffer GmbH & Co. KG, Fed. Rep. of Germany

[21] Appl. No.: 899,415

[22] Filed: Aug. 22, 1986

[30] Foreign Application Priority Data

Aug. 27, 1985 [DE] Fed. Rep. of Germany ..... 3530486

[51] Int. Cl.[4] ..... B65D 88/54

[52] U.S. Cl. ..... 222/321; 222/378

[58] Field of Search ..... 222/321, 380, 383, 385, 222/379, 378, 372, 377, 381; 417/559, 560, 566, 550

[56] References Cited

U.S. PATENT DOCUMENTS

| | | | |
|---|---|---|---|
| 2,150,485 | 3/1939 | Bernhardt | 222/321 |
| 3,583,605 | 6/1971 | Corsette | 222/321 |
| 3,640,470 | 2/1972 | Susaki et al. | 222/321 |
| 4,230,242 | 10/1980 | Meshberg | 222/321 |
| 4,262,823 | 4/1981 | Monden | 222/383 |

FOREIGN PATENT DOCUMENTS

| | | |
|---|---|---|
| 0088236 | 9/1983 | European Pat. Off. . |
| 3137760 | 7/1983 | Fed. Rep. of Germany . |
| 2711795 | 9/1978 | Fed. Rep. of Germany . |
| 2113149 | 9/1981 | Fed. Rep. of Germany . |
| 3339180 | 5/1985 | Fed. Rep. of Germany . |
| 2282545 | 3/1976 | France . |
| 2344339 | 10/1977 | France . |
| 2393279 | 12/1978 | France . |
| 2546483 | 11/1984 | France . |
| 2108207 | 5/1983 | United Kingdom . |

OTHER PUBLICATIONS

Search Report for German Appln. p. 35 30486.3.

*Primary Examiner*—Joseph J. Rolla
*Assistant Examiner*—Kenneth Noland
*Attorney, Agent, or Firm*—Steele, Gould & Fried

[57] ABSTRACT

A dispenser or delivery apparatus for flowable media, particularly very viscous or gel-like media, has a dosing chamber body (38) located within the stored medium and the body (38) moves backwards and forwards over part of the pump stroke of the pump piston (10) of a thrust piston pump (8). Body (38) defines the piston bath (53) for pump piston (10) surrounding pump chamber (59) and the valve body (48) of an intake valve (47) for pump chamber (59). Accompanied by reliable filling of pump chamber (59) and small piston paths, this leads to a very accurate dosing of the medium quantity discharged per piston stroke.

27 Claims, 6 Drawing Figures

19a
15a
20a
22a
11a
9a
30a
2a 15
21
19
16
14
11
3
7
1
23
9
2
6
36
31
29
37
8
52
43
38
48
4
5
39

3
6
30
29
60
32
8
2
46
54
41
44
56
45
62
40
38
43
58
10
61
53
57
48
55
4
5
51
49
50

DISPENSER FOR FLOWABLE MEDIA

BACKGROUND OF THE INVENTION

The present invention relates to a dispensing, delivering or distributing apparatus for flowable media, particularly pastes or the like, with a thrust piston pump having a casing, as well as a pump piston guided along a piston path of a pump cylinder between a starting position and a pump stroke end position, as well as a pump chamber formed by the pump cylinder and connected to a discharge opening of the apparatus and into which issues a media inlet closed during the pump stroke and open in at least one return stroke position of the pump piston.

With such dispensers and particularly if very viscous or gel-like media, such as pastes, ointments or other pasty pharmaceutical products have to be supplied, it is generally difficult to obtain a good delivery whilst expending little force and to ensure that on each occasion per pump cycle a relatively precisely identical medium volume is supplied, i.e. there is a high dosing precision.

SUMMARY OF THE INVENTION

The problem of the present invention is to provide a dispenser of the aforementioned type which, with a relatively small pump stroke, ensures a reliable and complete filling of the pump chamber during each pump cycle.

In the case of a dispenser of the aforementioned type, this problem is solved in that the piston path is provided on a dosing chamber body mounted in movable manner with respect to the casing and which surrounds the pump chamber, being movable with the pump piston between two end positions with respect to the casing, the pump stroke closing the inlet leading to the dosing chamber body. As a result of the dosing chamber body movement, the media inlet can be opened to a relatively large inlet cross-section and due to the fact that the dosing chamber body with the pump piston is moved into the position associated with the closed position of the media inlet, during said movement the dosing chamber body is immersed in the medium, so that in the case of limited force expenditure, the dosing chamber body is reproducibly filled with a precisely defined volume.

These advantages particularly occur if the dosing chamber body with its front, circular blade-like end in the direction of the pump piston stroke forms the movable valve closing part of an intake valve, which is immersed in an annular slot-like valve seat of the casing at the end of the following movement of the dosing chamber body associated with the pump stroke and consequently fixed by abutment both the associated end position of the dosing chamber body and alos at this instant seals in media-tight manner the dosing chamber body which was initially open to its full inside width at the end which faces the pump piston in the starting position, so that the cylinder chamber or pump chamber is then reliably closed at this cylinder face and is only open towards the discharge opening. Unlike in the case of an intake valve, whose closing part is mounted on the cylinder so as to be movable between an open and a closed position in the manner of a check valve, the invention leads to the important advantage that the valve closing part is controlled in a purely position-dependent manner by means of the pump piston or by the pump piston and also without any space expenditure can be constructed in such a way that there are extremely large inlet cross-sections when the intake valve is open. The inside width of the intake valve or the dosing chamber body forming the pump chamber and the piston path can be of the same order of magnitude as the pump stroke or can be much larger, e.g. more than twice as large as the latter.

The inventive construction is particularly suitable for those dispensers, which are constructionally combined with a media reservoir, i.e. do not have to be connected by means of a media supply line leading to the inlet to a separate media reservoir. In this case, the dosing chamber body can be arranged as a dipping or immersion member in floating manner completely within the stored medium, so that during its movement towards the closed position of the media inlet the dosing chamber body forces the media volume to fill the media inlet from the medium surrounding it.

Another important advantage of the inventive construction is that the dosing chamber body can be positioned directly adjacent to the bottom of the reservoir casing, i.e. at its end remote from the discharge and operating end, so that independently of the media reservoir filling level, there are always roughly identical operating conditions for the thrust piston pump located in the vicinity of the dosing chamber body or partly formed by the latter.

In addition, the inventive construction gives the possibility of constructing the dispenser in such a way that its spaces filled by the medium or through which the latter is to flow are sealed from the outside in air-tight manner prior to the first usage of the dispenser and/or following each pump stroke, so that the media content of the dispenser is always protected directly up to the discharge opening against drying out, penetration of bacteria and the like.

It can be particularly advantageous if said spaces of the dispenser are substantially filled with medium, i.e. up to the discharge opening or an outlet valve located in the vicinity thereof prior to the manufacture or first filling of the dispenser, so that during the complete operation of the thrust piston pump a full and precisely dosed discharge volume is provided. Appropriately the dispenser has at the end of the reservoir remote from the media inlet a drag piston, which can be constructed and arranged for the complete ventilation of the reservoir, as well as for the initial filling of the outlet duct in acoordance with German patent application No. P 35 05 911.7, to which reference should be made for further details.

In order to be able to ventilate the empty space behind the drag piston for an easy mobility of the latter, despite an air-tight closed construction in the initial or inoperative position of the thrust piston pump, with said empty space is associated a ventilating duct, which is only opened in position-dependent manner with respect to the pump piston if the latter is in a position differing from its starting position. A pump piston rod passing through this empty space and led out of the casing is led to the outside in sealed manner through an opening of the casing and outside the latter carries an operating member for the dispenser.

The sealing of the dispenser cavities associated with the medium can also be improved in that an outlet valve is arranged in the outlet duct between the pump piston and the discharge opening and preferably immediately adjacent to the latter and which in the case of pressure equilibrium on its two flow sides tightly seals the outlet duct. This outlet valve, which is appropriately constructed as a pressure relief valve can be a spring-loaded ball valve, as well as a hose valve according to DE-OS 29 02 624, to which reference should be made for details.

BRIEF DESCRIPTION OF THE DRAWINGS

The invention is described in greater detail hereinafter relative to non-limitative embodiments and with reference to the attached drawings, wherein show.

DETAILED DESCRIPTION OF THE PREFERRED EMBODIMENTS

Figures 1, 5, 6:
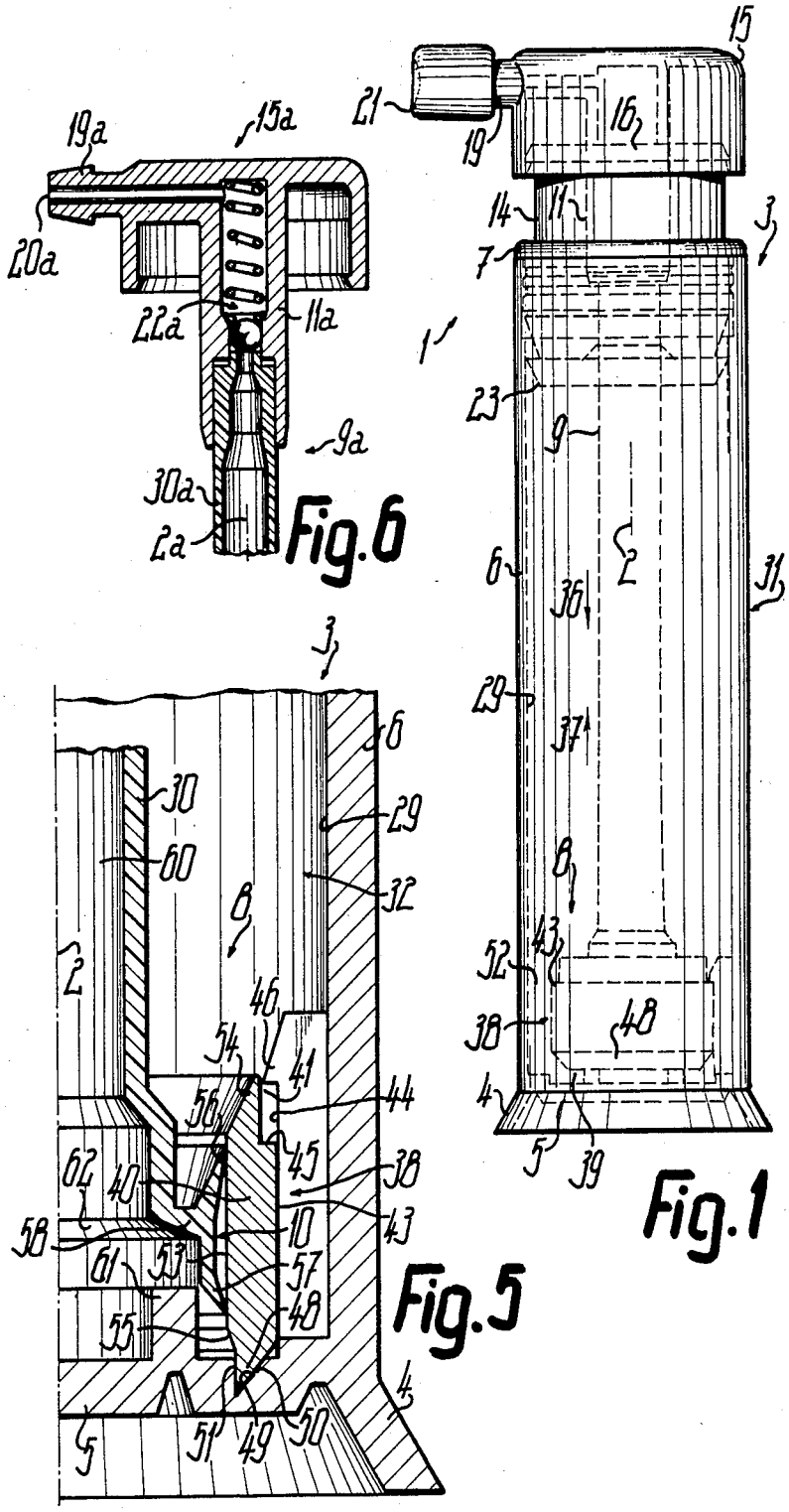
FIG. 1: A dispenser according to the invention in elevation.
FIG. 5: A detail of FIG. 2 on a larger scale and a different functional position.
FIG. 6: A detail of another dispenser embodiment.

The dispenser or delivery apparatus 1 according to FIGS. 1 to 4 has a casing 3 constructed in substantially axially symmetrical manner to a central axis 2 and which over most of its length has a constant, e.g. cylindrical cross-section and is provided at one end with a hollow frustum-shaped base 4, as well as a base wall 5 within the same in the form of a partition at right angles to the central axis 2 and which is constructed in one piece with the surface 6 of casing 3. The other end, open to its full inside width, of the one-part basic body of casing 3 is closed in air-tight manner by a front cover in the form of cover member 7, which engages with a ring flange in the inner face of surface 6 of casing 3. On the outer circumference of the ring flange and on the inner circumference of surface 6 are provided interengaging slots and rib webs passing in circular manner about the central axis 2 and which in the manner of seals ensure both a positive connection between surface 6 and cover 7 and also a tight closure. Cover 7 engages by a ring disk-like flange on the associated face of surface 6, said flange joining flush to the outer circumference of surface 6. Cover 7 is fixed in the manner of a circlip fixture by merely pressing it into surface 6.

Within the casing 3 is provided a thrust piston pump 8 coaxial to central axis 2 and whose pump piston 10 is close to base wall 5 and whose two-part piston rod 9 is led outwards through casing 3 and cover 7. The portion 11 of piston rod 9 passing through cover 7 is led outwards through an opening in end wall 12 of cover 7, there being provided on the outer circumference of portion 11 a ring packing, which is constructed in the form of an outwardly acute-angled, frustum-tapered annular sealing lip 13 in one piece with the end wall 12 or cover 7 and engages with pretension on the cylindrical outer circumference of portion 11. On the outside of end wall 12, cover 7 has a guide sleeve 14 constructed in one piece therewith and which is smaller than the width of surface 6 and which carries an operating member 15 for operating the dispenser or the thrust piston pump 8. The cap-like operating member 15 having substantially the same external diameter as casing 6 engages by its surface over the guide sleeve 14, the latter being provided on its outer end with a ring cam 16 projecting over its outer circumference and behind which engages a counter-ring cam 17 at the end of the surface of operating member 15, so that the latter is fixed by abutment in its initial or inoperative position remote from casing 3. The said cams have associated sloping abutting surfaces, so that the operating member 15 can only be mounted by pressing onto the guide sleeve 14, the counter-ring cam 17 passing over ring cam 16 accompanied by elastic widening and then snaps in place in its back-engaging functional position. In the starting position, the annular cams can abut against one another in air-tight manner, so that the area enclosed by guide sleeve 14 and operating member 15 is sealed in air-tight manner. On raising the counter-ring cam 17 from ring cam 16 as a result of an operation of operating member 15, a ventilation connection exists between said area and the outside. Portion 11 of piston rod 9 is constructed in one piece with operating member 15. Portion 11 is free from the inside of the end wall of operating member 15 and projects over the counter-ring cam 17. A restoring spring 18 is arranged around portion 11 in guide sleeve 14 and operating member 15 and one end thereof is supported on the outside of end wall 12 and the other end on the inside of the end wall of operating member 15. This restoring spring 18 can also be supported on an outer flank of the annular sealing lip 13, so that the latter is forced towards its sealing engagement by the spring pressure. The operating member 15 has a discharge connection 19 projecting radially from its surface in the vicinity of its end wall and which has a discharge opening 20 provided in its end face and which leads to the open. A sealing and protective cap 21 is removably engaged on the discharge connection 19 and by means of its spherical segmental, inwardly curved end wall so engages in the discharge opening 20 which is coaxial thereto that it tightly seals the same through uninterrupted engagement on its outer boundary edge. Discharge connection 19 contains an outlet valve 22 in the form of a ball pressure relief valve, which is spaced from opening 20 solely by the length of its valve spring.

Between the cover 7 and thrust piston pump 8 a drag piston 23 is provided in casing 3, sealingly engaging with two axially succeeding acute-angled, frustom-widened ring sealing lips 24, 25 directed away from the thrust piston pump 8 on the inner face 29 of casing surface 6 forming a piston path and sealingly engages on the outer circumference of a portion 30 of piston rod 9 in one piece with pump piston 10 by two inner annular sealing lips 27, 28 projecting in the same direction, but narrowed in acute-angled, frustum-shaped manner in this direction, as well as being slightly axially displaced towards thrust piston pump 8 with respect to the outer lips 24, 25. Between the thrust piston 23 and base wall 5, casing 3 with its surface 6 forms a media reservoir 31, whose storage area 32 has a circular cross-section. In this storage area 32 is located the thrust piston pump 8, but most of the storage area 32 is located behind pump 8, i.e. adjacent to that end thereof or the pump piston 10 which during the pump stroke constitutes the rear end thereof or which faces the cover 7 and operating member 15, from which the piston rod 9 is led to the outside. On the side of the drag piston 23 remote from the storage area 32, casing 3 surrounds an empty space 33 scaled with respect to the outside and which is also traversed by the piston rod 9 and is sealed in the vicinity of its passage through the end wall 12 by the annular sealing lip. With said empty space 33 is associated a ventilating duct 34, which can e.g. be formed by a single longitudinal groove 35 on the outer circumference of portion 11 of piston rod 9. In the initial position of pump piston 10 or operating member 15, ventilating duct 34 is hermetically sealed towards the empty space 33 in that the longitudinal groove 34 only passing over part of the length of portion 11 is located completely outside empty space 33 adjacent to the outside of annular sealing lip 13. If the operating member 15 is moved by a first portion out of its starting position in the pump stroke direction indicated by arrow 36, then the associated end of longitudinal groove 35 passes over the annular sealing lip 13, so that a ventilation connection is now formed between empty space 33 and the space surrounded by guide sleeve 14 and operating member 15. This remains open during the remaining pump stroke and only towards the end of the return stroke in the opposite direction according to arrow 37 is closed again. Thus, drag piston 23 can move unimpeded with the movements of the medium in storage space 32 in such a way that its end face defining said storage space and independently of the filling level of the latter remains in constant direct contact with the medium. The arrangement of the ventilation duct 35 is appropriately matched in such a way that said duct is open during the pump travel roughly in the position with respect to empty space 33 in which a still to be described intake valve of thrust piston pump 8 passes into the closed position, so that in the case of an overpressure in storage space 32, the drag piston 23 can only give way relatively difficulty, whereas it follows relatively easily in the case of an underpressure in storage space 32.

Thrust piston pump 8 has a dosing chamber body 38 suspended on pump piston 10 and movable therewith parallel to the central axis 2 in arrow directions 36, 37 between two end positions with respect to casing 3. Body 38 is completely arranged within the storage space or area 32 adjacent to the inside of base wall 5 and can be moved in the direction of arrows 36, 37 with respect to pump piston 10 by an amount which is larger than its maximum movement distance with respect to casing 3. Dosing chamber body 38 which, in the initial position of the pump piston 10 is closed by the latter in cup-shaped manner at the rear end remote from its medium inlet 39, has an in particular cylindrical jacket 40 coaxial to the central axis 2 of pump piston 10, so that the dosing chamber body 38 is formed by a simple sleeve. The outer cross-section of the dosing chamber body 38, adapted to the internal cross-section of casing 3 or surface 6, is smaller than the internal cross-section of surface 6 in such a way that roughly over its entire outer circumference 43, body 38 has a constant distance from the inner face 29 of surface 6. With the outer circumference 43, dosing chamber body 38 is guided on the edge faces of longitudinal webs 44 facing central axis 2, provided on the inner face of casing surface 6 and preferably constructed in one piece therewith. According to FIG. 3, there are three guidance longitudinal webs uniformly distributed about the central axis 2. Adjacent to its rear end 41, the outside width of the dosing chamber body 38 is reduced, so that a rearwardly directed stop shoulder 45 is formed with which dosing chamber body 38 engages in its initial position on stop cams 46, which in the represented embodiment are formed by the associated, radially inwardly projecting ends of longitudinal webs 44. These longitudinal webs 44 pass uniterruptedly through to the base wall 5.

In the vicinity of the front end 42 of the dosing chamber body 38, i.e. in the vicinity of media inlet 39, is provided an intake valve 47, which has an annular valve body 48 coaxial to central axis 2 and movable with respect to casing 3, as well as a valve seat 49 fixed with respect to casing 3. The cross-section of valve body 48 is blade-like or diverges in such a way towards the rear end 41 of dosing chamber body 38, that its outer flank formed by a frustum-shaped end face of body 38 diverges rearwards under an angle of roughly 90° or less, whereas its radially inner flank 51 formed by a cylinder surface is cross-sectionally substantially axially parallel to central axis 2 or to the movement direction of dosing chamber body 38. Valve seat 49 is formed by an annular groove in the inside of base wall 5, whose cross-section is so adapted to the cross-section of valve body 48, that with intake valve 47 closed, it engages with its flanks 50, 51 on the associated inner flanks of valve seat 49 in a substantially whole-area manner. However, the axial extension of at least the outer flank 50 of valve body 48 is larger than the axial extension of the associated sloping inner flank of valve seat 49, so that when the intake valve 47 is closed, said flank 50 still has a sloping portion projecting inwards over valve seat 49. Flank 50 is led up to the outer circumference 43 of the dosing chamber body 38. As a result of the described construction, dosing chamber body 38 can be moved backwards and forwards between the initial position fixed by stop cams 46 and a pump position fixed by engagement of valve body 48 in valve seat 49. For the fitting of the dosing chamber body 38, the stop cams 46 have on their sides facing central axis 2 sloping lead-in faces against which flank 50 of body 38 can be axially pressed in such a way that stop cams 46 give way under the elastic widening of container surface 6 until they snap in place behind stop shoulder 45. The axial travel of dosing chamber body 38 is much smaller than its external diameter, but in the starting position the front end face formed by the circular blade-like end lip of the valve body 48 is axially spaced from the inner face of base wall 5 or valve seat 49. As a result of the spacing between outer circumference 43 from container surface 6, between the longitudinal webs 44 are formed ring-cut-out-like media connections 52 between the main part of the media storage area 32 located behind the thrust piston pump 8 and the media intake 39.

The inner face of the jacket 40 of dosing chamber body 38 forms a constant width piston path 53, which is appropriately cylindrical, over most of its length. At the rear end, the piston path 53 passes into an inner, widened, annular driving shoulder 54 which appropriately diverges in acute-angled, frustum-shaped manner to the rear end face of dosing chamber body 38. At the front end, the piston path 53 also passes into an inner, widened, annular driving shoulder 55, which diverges in acute-angled, frustum-shaped manner towards the front end and whose cone angle is smaller than that of driving shoulder 54. Driving shoulder 55 is located at a distance behind the front end face of dosing chamber body 38 or valve body 48, which is at least as large as the depth of valve seat 49, the driving shoulder 55 passing appropriately directly into flank 51.

Pump piston 10 has two axially succeeding, annular, spring-elastic piston lips 56, 57 projecting radially over its remaining outer circumference, whereof the rear lip conically widens rearwards in obtuse or acute-angled manner and in the relaxed state has a greater outside width than the front piston lip 57, which is widened in acute-angled manner forwards with a smaller cone angle in the relaxed state. The piston lips 56, 57 have an axial spacing from one another which is smaller than the reciprocal axial spacing of driving shoulders 54, 55. The two piston lips 56, 57 start from a common annular lip root 58 forming the basic body for the pump piston 10 and to which is connected the associated portion 30 of piston rod 9. When the dispenser is in the starting position, the outer circumference of the rear piston lip 56 engages in a substantially whole-area manner on driving shoulder 54. The annular lip sealing face of piston lip 56 belonging to the piston path 53 consequently has a diameter which is much larger than that of the piston path 53. The lip sealing face provided at the front end of piston lip 57 engages on piston path 53 roughly in the centre of its length. If pump piston 10 is now moved in the direction of the pump stroke indicated by arrow 36, then by means of the piston lip 56 engaging on the driving shoulder 54 it moves the dosing chamber body 38 with it, so that its stop shoulder 45 is displaced from the stop cams 46. Valve body 48 is moved in the direction of valve scat 49, so that the cross-section of intake 39 is reduced and the intake valve 47 is finally closed. Flank 50 forces the medium completely surrounding dosing chamber body 38 to the outside and out of valve seat 49, whilst flank 51 passes in the manner of a scissor or shear blade into the associated flank of valve scat 49. If the dosing chamber body 38 has reached by abutment its end position on the transverse or base wall 5 and pump piston 10 is moved on in the same direction, in the manner of a spring detent the piston lip 56 passes off driving shoulder 54, the piston lip 56 being brought into an acute-angled, frustum shape.

Simultaneously pump piston 10 displaces the medium contained in pump chamber 59 surrounded by dosing chamber body 38 into a discharge duct 60, which forms the connection between pump chamber 59 and discharge opening 20. The end of the pump travel of piston rod 10 is fixed by a stop projecting over the inside of base wall 5 in the form of a stop ring 61 coaxial to central axis 2 and whose external diameter is smaller than the internal diameter of body 38 or the diameter of piston path 53 and with whose end face is associated as a counter-stop an inner stop shoulder 62, which is appropriately formed by the front end face of lip root 58. Thus, pump piston 10 is fixed before the piston lip 57 strikes against base wall 5, so that the piston lip 57 is protected. In the final phase of the pump stroke of piston 10 with respect to the dosing chamber body 38, accompanied by radial or conical widening, the front piston lip 57 passes into the area of driving shoulder 55 until engaging in substantially whole-area manner thereon on reaching the pump stroke end position according to FIG. 5. Together with the driving shoulder 55, the piston lip 57 also forms a non-positive, detachable locking connection between pump piston 10 and dosing chamber body 38, but whose locking force can be smaller than the locking connection between piston lip 56 and driving shoulder 54. In addition, the particular locking connection does not have to be directly provided between the particular piston lip and the dosing chamber body 38 and can instead also have a locking member on the piston unit which is separate from the particular piston lip. It is also conceivable to make the non-positive connection between pump piston 10 and dosing chamber body 38 so high that there is no need for driving shoulders and at least the front driving shoulder 55 and consequently the piston path 53 can pass uninterruptedly up to the associated end face of dosing chamber body 38. If the pump piston 10 is freed in the pump stroke end position, then it is moved back by the tension of restoring spring 18 in the direction of its return stroke indicated by arrow 37, without a separate spring being required for the dosing chamber body. As a result of the non-positive engagement in the dosing chamber body 38, piston 10 takes dosing chamber body 38 with it until body 38 is secured with respect to casing 3 by positive engagement of stop shoulder 45 on stop cams 46. During the further return stroke movement of pump piston 10, the front piston lip 56 detaches by running off driving shoulder 55 in the manner of a spring locking, so that the pump piston 10 returns to its starting position with respect to body 38, in which the piston lip 56 engages behind the driving shoulder 54 again. As a result of the return stroke movement of dosing chamber body 38, intake valve 47 is opened and during the further return travel of pump piston 10 an underpressure is built up in pump chamber 59, so that medium is sucked out of storage area 32 into pump chamber 59 through the media connection 52 and the annular media intake 39 bounded on the inner circumference by stop ring 61. Even in the starting position of dosing chamber body 38, the stop ring projects into its front end. The rear end of dosing chamber body 38 is also constructed in circular blade-like manner, one blade flank being formed by the driving shoulder 54, so that the body 38 can move in a relatively low resistance manner through the medium. According to the described operating process for the dispenser, a very accurate dosing is obtained in the case of an air-tight closure of the storage area 32. Although pump piston 10, which has a greater working stroke than dosing chamber body 38, is arranged at the end of a relatively long, bending-elastic piston rod 9, it is accurately guided by means of the body 38.

Portion 30 of piston rod 9 has a tubular construction, so that the associated portion of discharge duct 16 passes through the central axis 2 thereof. Adjacent to pump piston 10, portion 30 of piston rod 9 is extended in step-like manner, so that the discharge duct 60 has a multiply-stepped internal cross-section in the outflow direction from pump chamber 59. The end of portion 30 remote from pump piston 10 is inserted in portion 11 of piston rod 9 and is consequently secured with respect to operating member 15 both axially and about the central axis 2. The discharge duct 60 also passes through the tubular portion 11 of piston rod 9 and issues into a radial duct 63, in which is located the outlet valve 22 and which is equiaxial to discharge opening 20.

Figures 2, 3, 4:
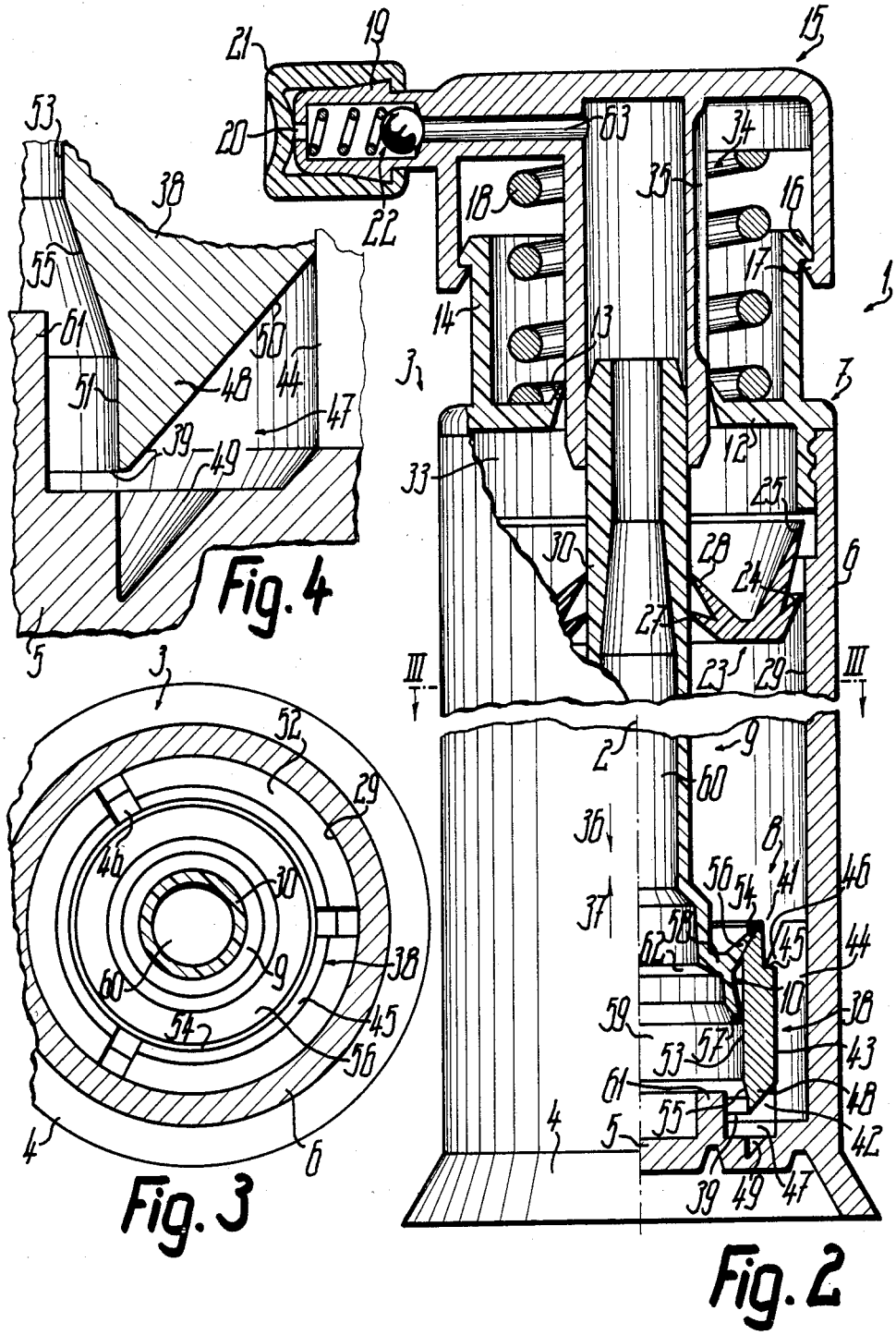
FIG. 2: The dispenser according to FIG. 1, partly in axial section.
FIG. 3: A section along line III—III of FIG. 2.
FIG. 4: A detail of FIG. 2 on a larger scale and a different functional position.

In FIG. 6 corresponding parts carry the same reference numerals as in FIG. 2, but followed by the letter 'a'. Outlet valve 22*a* in the embodiment according to FIG. 6 is further from the discharge opening 20 in central axis 2*a* and is in fact located within the portion 11a of piston rod 9*a* belonging to operating member 15*a*. The valve seat is formed by the associated end of the portion 30*a* of piston rod 9*a* associated with the pump piston on which the valve body of outlet valve 22*a* formed by a ball engages under the tension of a valve spring located within portion 11*a*.

What is claimed is:

1. A dispenser for flowable media comprising:

a thrust piston pump (8) having a casing (3);

a pump piston (10) having a means to be displaceably guided on a piston path (53) of a pump cylinder over a pump stroke and a return stroke between a starting position and a pump stroke end position;

a pump chamber (59) formed by the pump cylinder, the pump chamber being connected to a discharge opening (20) of said dispenser, so that the flowable media flows within the pump chamber and a discharge duct during discharge of the flowable media;

a media inlet (39) issuing into said pump chamber (59) and being closed during the pump stroke and open in at least one position of the return stroke of said pump piston (10), wherein the means to be displaceably guided on a piston path (53) is defined by a dosing chamber body (38) surrounding said pump chamber (59), said dosing chamber body (38) being movable commonly with said pump piston (10) with respect to said casing (3), in driving directions between two end positions, said dosing chamber body closing the media inlet (39) during relative movement of the pump piston (10) in the dosing chamber body during the pump stroke.

2. A dispenser according to claim 1, wherein the media inlet (39) is closed by an inlet valve (47), said inlet valve being opened and closed as a function of position of the dosing chamber body (38) by means of a valve body (48) and a valve seat (49).

3. A dispenser according to claim 2, wherein the valve body (48) of said inlet valve (47) is provided directly on said dosing chamber body (38).

4. A dispenser according to claim 2, wherein the inlet valve (47) is annular about a central axis (2) and forms a jacket (40).

5. A dispenser according to claim 4, wherein the valve body (48) of said inlet valve (47) is provided at the end of the jacket (40) of the dosing chamber body (38).

6. A dispenser according to claim 2, wherein the valve seat (49) of said inlet valve (47) forms a stop face defining an associated end position of the dosing chamber body (38).

7. A dispenser according to claim 2, wherein the valve seat (49) is formed by a depression in a partition (5) of the casing (3), said depression being cross-sectionally adapted to the valve body (48).

8. A dispenser according to claim 1, wherein in at least one of said driving directions (36, 37) the pump piston (10) engages frictionally in the dosing chamber body (38) forming the pump cylinder.

9. A dispenser according to claim 8, wherein the pump piston engages in the dosing chamber body along at least one piston lip (56, 57) on the pump piston.

10. A dispenser according to claim 1, wherein the pump piston (10) and the dosing chamber body (38) are movably positioned with respect to each other between two opposite end positions, said pump piston (10) engaging the piston path (53) of the dosing chamber body (38) between said two opposite end positions by a predetermined friction providing a first coupling force engaging the pump piston (10) to the dosing chamber body (38), a spring biased locking means being provided for coupling the pump piston (10) and the dosing chamber body (38) in at least one of said end positions by a frictional second coupling force, said second coupling force being greater than said first coupling force.

11. A dispenser according to claim 1, wherein the dosing chamber body (38) has at least one driving shoulder (54, 55) for locking engagement with a piston lip (56, 57) of the pump piston (10).

12. A dispenser according to claim 1, wherein the pump piston (10) has two substantially oppositely projecting conical piston lips (56, 57), whereof one of said lips in a starting one of said two end positions engages behind a conical driving shoulder (54) in the vicinity of a rear end (41) of the dosing chamber body (38) and the other sealing lip (51) in a pump stroke end position of said tow end positions engages behind a conical driving shoulder (55) in the vicinity of a front end (42) of the dosing chamber body (38).

13. A dispenser according to claim 1, wherein a starting one of the two end positions of the dosing chamber body (38) is defined by a stop between the dosing chamber body (38) and the casing (3), the dosing chamber body (38) being provided on an outer circumference of the dosing chamber body (38) in the vicinity of a rear end (41) thereof, with a stop shoulder (45), engageable against at least one stop cam (46) provided on the inside of the casing (3).

14. A dispenser according to claim 1, wherein the dosing chamber body (38) is formed by a sleeve-like container jacket (41) open at least to the width of the piston path (53) on a rear end and a front end (41, 42) thereof.

15. A dispenser according to claim 1, wherein a pump stroke end position of the two end positions of the pump piston (10) is fixed by abutment of the pump piston with respect to the casing (3), the partition (5) of the casing (3) being provided with stop ring (61) projecting towards the pump piston (10) and being engageable with a stop shoulder (62) provided on an inside of the pump piston (10) adjacent a lip root (58) leading to a plurality of piston lips (56, 57) for sealing the pump piston to the dosing chamber body.

16. A dispenser according to claim 1, wherein the discharge duct (60) leading from the pump chamber to the discharge opening (20) is open towards the pump chamber (59) and leads through the pump piston (10).

17. A dispenser according to claim 16, wherein the discharge duct (60) leads at least partly through a tubular piston rod (9) constructed in one piece with the pump piston (10), an end of said discharge duct remote from the pump piston being connected to an operating member (15) for the piston pump (8), said operating member having the discharge opening (20) therein.

18. A dispenser according to claim 1, wherein the casing (3) is at least partly constructed as a media reservoir (31) open by means of the media inlet (39) to the dosing chamber body (38) and forming a storage area defining a media filling volume, the dosing chamber body being entirely located within the storage area (32) and substantially coaxial therewith.

19. A dispenser according to claim 18, wherein the storage area (32) of the casing (3) is substantially provided behind a rear end (41) of the dosing chamber body (38), a media connection (52) being defined from said storage area (32) along an outer circumference (43) of the dosing chamber body (38) to the media inlet (39), the media inlet being provided adjacent a base wall (5) of the casing (3).

20. A dispenser according to claim 19 wherein the media connection (52) is formed by a gap between the outer circumference (43) of the dosing chamber body (38) and an inner face (29) of casing (3).

21. A dispenser according to claim 1, wherein the dosing chamber body (38) is mounted directly on the casing (3) and is guided by its outer circumference (43) on longitudinal webs (44) of the casing (3), said webs passing into stop cams (46) for the dosing chamber body.

22. A dispenser according to claim 18, wherein an end of the storage area (32) remote from media inlet (39) is bounded by a drag piston (23) being guided on an inner face (29) of the casing (3) and on an outer face of the piston rod (9) by sealing lips (24, 25, 27, 28).

23. A dispenser according to claim 22, wherein a ventilating duct (34) issues into an empty space (33) behind the drag piston (23), the ventilating duct (34) being closed in a starting one of the two end positions of the pump piston (10).

24. A dispenser according to claim 23, wherein the ventilating duct (34) is formed by at least one longitudinal groove (35) in a portion (11) of the piston rod (9) provided on an operating member (15), said groove (35) being located entirely outside the empty space (3) in the starting one of the end positions.

25. A dispenser according to claim 1, wherein the piston rod (9) of the pump piston (10) is led out of the casing (3) in sealed manner, said casing (3) being provided on an associated end wall (12) with a sealed-in cover (7) having an annular sealing lip (13) constructed in once piece with said cover and guided on an outer circumference of a portion (11) of the piston rod (9) provided on an operating member (15) for the piston pump.

26. A dispenser according to claim 1, further comprising an outlet pressure relief valve (22) arranged adjacent to the discharge opening (20) in a discharge duct (60), said valve tightly sealing the discharge duct (60) in an inoperative position thereof.

27. A dispenser according to claim 26, wherein the pressure relief valve (22) is a spring-loaded ball valve.

* * * * *